United States Patent [19]

Marte et al.

[11] Patent Number: 4,950,306

[45] Date of Patent: Aug. 21, 1990

[54] DYEING AND PRINTING OF CELLULOSIC FIBRE MATERIALS WITH VAT DYES WITH MONO- OR DI-HYDROXYACETONE AS REDUCING AGENT

[75] Inventors: Walter Marte, Ulisbach; Paul Rys, Zurich, both of Switzerland

[73] Assignee: Ciba-Geigy Corporatioin, Ardsley, N.Y.

[21] Appl. No.: 386,529

[22] Filed: Jul. 27, 1989

[30] Foreign Application Priority Data

Jul. 29, 1988 [CH] Switzerland ..... 2891/88

[51] Int. Cl.[5] ..... C09B 7/00; C09B 67/00; D06P 1/24; D06P 3/60

[52] U.S. Cl. ..... 8/607; 8/650; 8/652; 8/653; 8/918

[58] Field of Search ..... 8/607, 653

[56] References Cited

U.S. PATENT DOCUMENTS 3,883,299 5/1975 Baumgarte et al. ..... 8/578
4,526,701 7/1985 Rubin ..... 8/525

*Primary Examiner*—A. Lionel Clingman
*Attorney, Agent, or Firm*—Kevin T. Mansfield; Edward McC. Roberts

[57] ABSTRACT

Process for dyeing and printing cellulosic fiber materials with vat dyes in the presence of enediols as reducing agents and alkali, using in addition small amount of organic water-miscible solvents, for example low molecular weight alcohols, when reducing the vat dyes. The vatting of the vat dyes proceeds uniformly and completely within a relatively short time, and the resulting vat dyes are reproducible and notable for high levelness and fastness properties.

15 Claims, No Drawings

DYEING AND PRINTING OF CELLULOSIC FIBRE MATERIALS WITH VAT DYES WITH MONO- OR DI-HYDROXYACETONE AS REDUCING AGENT

The present invention relates to a process for dyeing and printing cellulosic fibre materials with vat dyes in the presence of enediols as reducing agents and alkali.

The dyeing and printing of cellulosic fibre materials with vat dyes is in general carried out in alkaline media with sodium dithionite (hydrosulfite) as reducing agent and in general in the presence of appreciable amounts of complexing agent. Hydrosulfite is a strong reducing agent even at low temperature, but in alkaline solution it is sensitive to oxygen. Oxidation of hydrosulfite gives sodium sulfate, which is only incompletely removable from the dyehouse waste waters. Waste waters having a high sulfite/sulfate content are corrosive and this can for example destroy waste water lines (concrete pipes). If sulfate deposits are formed, furthermore, hydrogen sulfide can form by anaerobic degredation. Another problem is the presence of complexing agent in the waste water.

There have been previous attempts to replace hydrosulfite as a vatting (reducing) agent for the dyeing with vat dyes wholly or in part, inter alia by enediols, which give strongly negative redox potentials in an alkaline medium.

However, work on the vatting (reduction) of vat dyes, in particular indigo, with enediols gave only unsatisfactory results, in particular since the vatting process was only incomplete and the dyeings obtained were unable to meet the high requirements, for example in respect of constancy of shade and levelness.

It is an object of the present invention to provide without using hydrosulfite as the vatting agent a process for dyeing and printing cellulosic textile materials with vat dyes which ideally gives complete vatting and leads to dyeings which meet the stated high requirements.

It has now been found that the stated object is achievable according to the invention by using in addition small amounts of organic water-miscible (hydrophilic) solvents to reduce the vat dyes.

More particularly, the process according to the invention is suitable for dyeing cellulosic fibre materials with vat dyes from aqueous alkaline dyeing liquors in the presence of enediols as reducing agents, said dyeing liquors additionally containing 0.1 to 10% by weight of water-miscible organic solvent.

The present invention further provides the aqueous alkaline dyeing liquors or print pastes for carrying out the dyeing process according to the invention, vat dye preparations (stock vats), from which the dyeing liquors/print pastes can be prepared, and the dyed and printed (textile) cellulosic fibre materials obtained by the process.

Vat dyes for the purposes of the present invention are to be understood as meaning not only indigoid dyes, of which indigo itself is preferred, but also anthraquinoid dyes and prereduced or unprereduced sulfur dyes. For details see the sections dealing with vat and sulphur dyes in the Colour Index (C.I.), third edition, 1971, published by the Society of Dyers and Colourists.

The aqueous alkaline liquors in which the dyeings are carried out are strongly alkaline; that is, they have a pH within the range from about 11 to 14, preferably from 12 to 14, or from 13 to 14.

The pH is in general set by means of aqueous alkali metal hydroxide, in particular sodium hydroxide, or else potassium hydroxide solutions.

The vat dyes are reduced in the process according to the invention by means of enediols. They are in general α-hydroxycarbonyl compounds which have a strongly reducing action in an alkaline medium.

Typical compounds which form enediols (enediolates) in an alkaline medium are in particular low molecular weight($C_2$–$C_6$)-α-hydroxyketones and α-hydroxyaldehydes, for example monohydroxyacetone, dihydroxyacetone, glycolaldehyde, dihydroxybutanone, 2,3-dihydroxyacrylaldehyde (triose reductone), ascorbic acid and cyclopentenediolon (reductic acid).

Particular preference is given to mono- and dihydroxyacetone.

The reducing agent is in general used in an amount of about 20 to 100% by weight, preferably 20 to 80% by weight, based on the dye.

Suitable organic solvents in the process according to the invention should be water-miscible, i.e. form a homogenebus phase with the water, at least in the indicated amounts of 0.1 to 10, in particular 0.1 to 5, % by weight, in which they are used in the dyebaths.

However, since it also possible to start from stock vats which, following appropriate continuous or batchwise dilution, form the dyebaths, the solvents mentioned should preferably be still water-miscible within a much larger amount, i.e. up to about 50% by weight (range from 0.1 to 50% by weight).

It is possible to use not only protic but also aprotic organic solvents which should not have a reducing effect. They are in particular low molecular weight solvents, such as

- $C_1$–$C_4$alcohols, e.g. methanol, ethanol, n-propanol, isopropanol or n-butanol, of which methanol and isopropanol are particularly preferred;
- ketones, e.g. acetone, methyl ethyl ketone, diethyl ketone, 4-hydroxy-4-methyl-2-pentanone (diacetone alcohol) and cyclohexanone;
- ethers, e.g. diisopropyl ether, dioxane and tetrahydrofuran;
- acetals, e.g. glycol formal and glycerol formal;
- glycols and glycol ethers, e.g. ethylene glycol, propylene glycol, ethylene glycol monomethyl, monoethyl or monobutyl ether, diethylene glycol monomethyl or monoethyl ether and ethylene glycol dimethyl ether;
- thioglycols, e.g. thiodiglycol;
- nitriles, e.g. acetonitrile;
- pyridines, e.g. pyridine and the picolines (α, β, γ);
- lactones, e.g. γ-butyrolactone;
- lactams, e.g. pyrrolidone, N-methylpyrrolidone and 1,5-dimethylpyrrolidone;
- $C_2$–$C_4$alkanolamines, e.g. primary, secondary or tertiary alkanolamines, preferably ethanolamine, diethanolamine, triethanolamine, n-propanolamine or isopropanolamine;
- amides of lower carboxylic acids or inorganic acids, e.g. formamide, N,N-dimethylformamide, acetamide, N,N-dimethylacetamide, tris(dimethylamido)-phosphate and bis(dimethylamido)methane phosphate;
- ureas, e.g. N,N,N',N'-tetramethylurea;
- sulfones or sulfoxides, e.g. sulfolane (tetramethylene sulfone), 3-methylsulfolane and dimethyl sulfoxide.

It is also possible to use mixtures of the solvents mentioned.

The process according to the invention, which is carried out using a combination of enediols as reducing agents and organic water-miscible solvents, is suitable for virtually any dyeing and printing process involving vat dyes, in particular indigo.

These processes can be carried out within the temperature range from room temperature (15° to 20° C.) to about 120° C., in particular 15° to 80° C. The good stability of the reducing agent paired with the relatively unstable hydrosulfite makes it possible, when working from a dyebath, for example on a jigger, on a winch beck, a packaging dyeing machine or a pad-mangle, to use distinctly smaller amounts of reducing agent than hitherto customary. For the same reason, it is possible to dye on the above-mentioned machines at higher temperatures than hitherto, thereby obtaining very level dyeings.

The process according to the invention is also suitable for continuous dyeing, for example a pad-steam process, or as a cold pad-batch process. In the pad-steam process, the vat dye is applied as a pigment to the textile material, and the textile material is then in general intermediarily dried; thereafter an aqueous liquor containing the reducing agent/solvent combination is applied, and the dyeing is developed (reduced) at elevated temperatures, for example in a steam atmosphere at 100° C., and then finished in a conventional manner, for example by rinsing, oxidizing and soaping.

The pad-steam process using hydroxyacetone as the reducing agent cuts the consumption of reducing agent by more than 50% by weight compared with the conventional dithionite process.

The same advantages are obtained on using the cold pad-batch process. In this process, a fabric which has been padded with a vat or sulfur dye is impregnated with a reducing agent liquor of the stated composition, wound up and left at room temperature for several hours, during which the dye undergoes reduction and fixation. The fabric is then finished in a conventional manner.

If desired, the process according to the invention may also be carried out as a single-bath padding process by applying an aqueous liquor which contains the vat dye, alkali, the reducing agent and the organic solvent to the textile material, developing the dyeing by steaming or cold storage and then finishing it in a conventional manner.

Finally, the process according to the invention can also be carried out as a printing process, for example as a two-phase printing process, by printing the vat dyes in place by means of a print paste containing customary thickeners and reducing agents, drying intermediarily, padding with a solvent- and alkali-containing padding liquor, and developing in a steamer suitable for two-phase printing, and thereafter again finishing in a conventional manner by rinsing, oxidizing and soaping.

In the direct printing process, the print paste contains thickener, alkali, reducing agent and solvent as well as the dye.

The aqueous dyeing liquors/print pastes for carrying out the dyeing process according to the invention through a bath (in single-bath form) form a further part of the subject-matter of the present invention. They contain the vat dye, an alkali metal hydroxide, an enediol as reducing agent and 0.1 to 10% by weight, based on the dyeing liquor/print paste, of a water-miscible organic solvent, and further, customary assistants.

The amounts of dye, alkali and reducing agent in these dyeing liquors can vary within wide limits.

In general, the amount of dye, which depends on the desired depth of shade, is from 0.1 to 7% by weight, based on the substrate to be dyed.

The amount of alkali should be sufficient to establish a pH within the range from 11 to 14, preferably 12 to 14 or 13 to 14.

The amount of reducing agent is about 0.01 to 10% by weight, based on the weight of the dyeing liquor.

To prepare the aqueous dyeing liquors/print pastes for use according to the invention, it is possible to use (concentrated) vat dye preparations, which form a further part of the subject-matter of the present invention, which as well as the vat dye contain the reducing agents and solvents mentioned with or without customary assistants such as dispersants and standardizing agents, and water.

The amount of reducing agent is about 1 to 2, preferably 1.4 to 1.6, vatting equivalents per equivalent of dye, one vatting equivalent being the amount of reducing agent which can ensure adequate (complete) vatting.

The amount of solvent is chosen to be such that, following preparation of the dyeing liquors, the stated amount of 0.1 to 10% by weight is present.

The amount of water depends on whether the vat dye preparations are solid, pasty or liquid.

To ensure that they remain stable they are made acid or neutral. Immediately before they are used for preparing the dyeing liquors mentioned, they are made alkaline (pH 11–14) by the addition of suitable alkali and, where appropriate, diluted with water.

The vatting of the vat dyes can be carried out during the actual dyeing/printing process or else separately therefrom (prevatted dye preparations which can be used for preparing dyeing liquors or print pastes).

By the process according to the invention it is possible to combine the (pre)vatting of the dyes and the actual dyeing and printing of textile materials with one another in a continuous form by further using the (stable) preparations containing the vatted dyes directly for dyeing and printing.

The stability of the vat dye preparations and/or of the dyebaths/print pastes and hence their application properties may in certain circumstances additionally be improved by subjecting the suspensions from which they are prepared and which contain the sparingly soluble vat dyes and also, as further components, water, alcohols, reducing agents, surfactants, alkali metal hydroxides and any further customary additives to ultrasound. By means of such ultrasound treatment it is possible to obtain dye preparations or dyebaths or print pastes which show a significantly more homogeneous and finely particled dispersion of vat dyes, as a result of which it is possible to obtain at the same time improved reduction (higher concentration of vatted dye) and hence a higher dye yield on the substrate.

The amount of reducing agent and of the other components used can thus in general be reduced.

The general procedure here is first to stir the dyestuff suspension and then to comminute the dye aggregates by means of ultrasound. The dissolving and vatting process for vat dyes can thus be significantly shortened; this also makes it possible, as stated, to carry out the dyeing process with the vat dyes in a continuous manner.

The ultrasound waves which are used in the process are generated in a customary ultrasound generator.

Their frequency is within the range from 16 kHz and higher, for example within the range from 18 to 35 kHz, preferably 20 to 25 kHz. The ultrasound energy to be employed depends on the identity of the dye but also on other reaction conditions, such as temperature, solvent, particle size of the dye, etc. Normally, an energy input of 50 to 100 watt (5 to 10 mkg/s) for a dye preparation used in the examples below is sufficient.

The novel process for dyeing and printing with vat dyes can be used for cellulosic fibre materials in a wide range of textile processing states. For instance, fibres, filaments, yarns, woven fabrics or knitted fabrics made preferably of natural and/or regenerated cellulose, but also blend fabrics or blend yarns which additionally contain a portion of further natural or synthetic fibres, for example customary polyamide or polyester fibres, can be dyed or printed. If the non-cellulosic fibre is to be dyed at the same time, it is possible to use the dyes suitable for this purpose (for example acid or disperse dyes).

The process according to the invention gives surprising advantages in the field of dyeing and printing cellulosic textile fibre materials with vat dyes, in particular indigo.

They are, inter alia, the uniform and complete reduction of the vat dyes (no overreduction); the high stability of the reduced (vatted) dye liquor —no precipitation of the vatted dye even at relatively high concentrations —which is particularly important for the use of stock vats, which should have sufficiently long lifetime (several hours). This simplifies the dyeing in deep shades, making it possible to obtain level dyeings.

A further notable advantage is the improvement in the textile properties of the dyed textile fibre material due to the low salt content of the rinse baths (reduced salt deposits on the fibre materials), the simple metering of the (liquid) reducing agents and organic solvents, and the excellent reproducibility of the dyeings.

The dyes (indigo) are if need be recoverable from the dyehouse waste waters in a relatively simple manner and without interference due to an excessively high salt content, for example by ultrafiltration. In a subsequent biological treatment stage it is possible to remove organic substituents from the waste water, and finally to recycle the waste water thus treated back into the dyeing process.

The possibility of treating and reusing waste waters in this way arises in particular from the fact that the presence of sulfites/sulfates can be avoided in the waste water.

In this way it is possible to cut the pollutant content of the waste water to a substantial degree.

Finally, the solvents can likewise be at least partly recovered and reused or otherwise utilized.

The Examples describe the present invention in further detail without limiting it. Parts and percentages are by weight. The temperature is given in degrees Celsius.

EXAMPLE 1

Prescoured cotton fabric is introduced into a jigger containing a dyeing liquor of the following composition:

| | |
|---|---|
| 4 | parts of indigo |
| 2 | parts of methanol |
| 2 | parts of monohydroxyacetone |
| 10 | parts of an anionic surfactant (10% solution of Subitol RZO ®) |
| 25 | parts aqueous sodium hydroxide solution (40%) |
| 957 | parts of water |
| 1,000 | parts |

The temperature of the liquor is 50° C. The liquor ratio is 1:6.

Following a dyeing time of 30 minutes, the fabric is oxidized and soaped in a conventional manner.

The result is a deep blue level dyeing having good fastness properties.

The virtually exhausted liquor is subjected to ultrafiltration to recover the remaining dye, and the remaining waste water can be fed directly into a biological disposal unit and be reused where possible.

EXAMPLE 2

Grey cotton yarn is dyed continuously at a rate of 40 m/minute in a continuous dyeing machine by the stock vat method. The stock vat is continuously introduced into the dyebath in a dilution of 1:20. The stock vatting takes place away from the dyebath at 50° C. The stock vat has the following composition:

| | |
|---|---|
| 80 | parts of indigo |
| 50 | parts of isopropanol |
| 50 | parts of monohydroxyacetone |
| 5 | parts of an anionic wetting agent (10% aqueous solution of Subitol RZO ®) |
| 150 | parts of aqueous sodiumhydroxide solution (40%) |
| 665 | parts of water |
| 1,000 | parts |

The temperature of the dyeing liquor is 40° C. The wet pick-up is 60% by weight.

This is followed by customary oxidation and finishing.

The result is a deep blue level yarn having good allround fastness properties.

The dye pigment dissolved off during the washing process is recovered by means of an ultrafiltration unit, and the permeate is subjected to an anaerobic waste disposal treatment.

EXAMPLE 3

(a) Cotton yarn in package form (cross-wound bobbins) is dyed in a commercial yarn dyeing machine in a liquor ratio of 1:12 with a bath of the following composition:

| | |
|---|---|
| 10 | parts of the dye C.I. Vat Orange 29 |
| 50 | parts of ethanol |
| 8 | parts of monohydroxyacetone |
| 30 | parts of aqueous sodium hydroxide solution (40%) |
| 902 | parts of water |
| 1,000 | parts |

The temperature of the liquor is raised from 20° C. to 60° C. in the course of 15 minutes, and dyeing is carried out at that temperature for 30 minutes. This is followed by rinsing, oxidizing and finishing in a conventional manner. The dyeing is notable for good package flow and high levelness.

(b) Example (3a) is repeated, except that the dyebath, before it is introduced into the yarn dyeing machine, is treated with ultrasound (22 kHz, 70 watt, 55° C.), speeding up the vatting of the dye and raising the degree of vatting. This given an improved dye yield on the fibre and dyeings which are deeper in shade.

(c) Example (3a) is repeated with 10 parts of the dye of the formula C.I. Vat Blue 6 (C.I. No. 69825). The dyeing likewise shows good levelness and has good fastness properties.

EXAMPLE 4

(a) Cotton fabric is dyed at 60° C. on a commercial jet machine in a liquor ratio of 1:10. The dyebath is made up similarly to a stock vat.

The stock vat has the following composition:

| | |
|---|---|
| 40 | parts of the dye C.I Vat Blue 6 (C.I. No. 69825) |
| 250 | parts of methanol |
| 30 | parts of monohydroxyacetone |
| 72 | parts of aqueous sodium hydroxide solution (40%) |
| 608 | parts of water |
| 1,000 | parts |

The vatting takes place at 60° C.; the stock vat is diluted after about 30 minutes' reaction with water in a ratio of 1:5, so that the methanol content of the dyebath is only about 4% by weight. The liquor thus diluted is introduced into the dyeing machine and circulated for 40 minutes. Virtually no foam is formed. The fabric is then oxidized and finished in a conventional manner.

The blue dyeing obtained is notable for high levelness.

(b) Example (4a) is repeated with 40 parts of the dye C.I. Vat Orange 29. Again the result is a level dyeing having good all round fastness properties.

EXAMPLE 5

A cotton fabric is printed with a print paste containing an unprereduced sulfur dye and monohydroxyacetone, and dried. It is then padded with an alkali- and solvent-containing aqueous solution of the following composition:

Print paste:

| | |
|---|---|
| 150 | parts of C.I. Sulfur Black 11 |
| 50 | parts of monohydroxyacetone |
| 150 | parts of a thickener (Monagum B ®, 10%) |
| 350 | parts of a thickener (Meyprogum CRN ®, 5% |
| 300 | parts of water |
| 1,000 | parts |

Padding solution:

| | |
|---|---|
| 720 | parts of water |
| 100 | parts of diethylene glycol monomethyl ether, |
| 100 | parts of ethylene glycol |
| 80 | parts of aqueous sodium hydroxide solution (40%) |
| 1,000 | parts |

This is followed by a saturated steam fixation for 30 seconds and the oxidation and rinsing process. Finishing is carried out in a conventional manner.

The result is a black cotton fabric of high levelness.

The process if notable for high reproducibility in respect of color strength and levelness. A further advantage is the high paste stability despite the presence of reducing agent.

EXAMPLE 6

Prescoured cotton fabric is dyed in the jigger containing the following dyeing liquor:

| | |
|---|---|
| x | parts of dye |
| 50 | parts of methanol |
| 5 | parts of monohydroxyacetone or dihydroxyacetone |
| 100 | parts of aqueous sodium hydroxide solution (40%) |
| y | parts of water |
| 1,000 | parts |

The liquor ratio is 1:20, the pH 13.1. Following a dyeing time of 45 minutes the fabric is oxidized and soaped in a conventional manner. The dyes indicated in Table 1 give level and fast dyeings in the hues mentioned.

TABLE 1

| Dye | Parts of dye (x) | Parts of water (y) | Dyeing temperature (°C.) | Hue of dyed fabric |
|---|---|---|---|---|
| C.I. Vat Blue 18 (C.I. 59815) | 1.05 | 843.95 | 55 | Blue |
| C.I. Vat Green 3 (C.I. 69500) | 1.3 | 843.7 | 55 | Green |
| C.I. Vat Red 10 | 2.5 | 842.5 | 55 | Red |
| C.I. Vat Brown 1 (C.I. 70800) | 1.3 | 843.7 | 55 | Brown |
| C.I. Vat Orange 11 (C.I. 70805) | 1.3 | 843.7 | 55 | Yellow |
| C.I. Vat Blue 4 (C.I. 69800) | 1.95 | 843.05 | 55 | Blue |
| C.I. Vat Black 25 (C.I. 69525) | 1.4 | 843.6 | 55 | Black |
| C.I. Vat Green 1 (C.I. 59825) | 0.85 | 844.15 | 63 | Green |

it is also possible to use, with similar results, ethanol, n-propanol, isopropanol, n-butanol, acetone, methyl ethyl ketone, cyclohexanone, diisopropyl ether, dioxane, tetrahydrofuran, glycerol formal, glycol formal, ethylene glycol, propylene glycol, ethylene glycol dimethyl ether, ethylene glycol monomethyl, monoethyl or monobutyl ether, diethylene glycol monomethyl or monoethyl ether, thiodiglycol, acetonitrile, pyridine, γ-butyrolactone, pyrrolidone, N-methylpyrrolidone, 1,5-dimethylpyrrolidone, formamide, N,N-dimethylformamide, acetamide, N,N-dimethylacetamide, tris(dimethylamido) phosphate, bis(dimethylamido)methane phosphate, N,N,N',N'-tetra-methylurea, tetramethylene sulfone, β-methyl sulfolan, dimethyl sulfoxide, ethanolamine, diethanolamine, triethanolamine, n-propanolamine or isopropanolamine.

In place of the 100 parts of aqueous sodium hydroxide solution (40%) it is also possible to use dyeing liquors which contain 50 parts of the aqueous sodium hydroxide solution mentioned.

EXAMPLE 7

Cotton fabric is dyed at 55° to 60° C. on a commercial jet machine in a liquor ratio of 1:10. The dyebath is made up similarly to a stock vat:

The stock vat has the following composition:

| | |
|---|---|
| x | parts of dye |
| 50 | parts of methanol |
| 5 | parts of monohydroxyacetone or dihydroxyacetone |
| 100 | parts of aqueous sodium hydroxide solution |
| y | parts of water |

-continued

| |
|---|
| 1,000 parts |

The vatting takes place at 55° C.; the pH is 12.9. The stock vat is diluted after a reaction time of about 20 minutes with water in a ratio of 1:5.

The dyeing liquor thus obtained is pumped into the dyeing machine and circulated therein at 55° to 60° C. for 45 minutes. This is followed by oxidization and finishing in a conventional manner.

Using the dyes indicated in Table 2 it is possible to obtain level and fast dyeings in the indicated hues.

TABLE 2

| Dye | Parts of dye (x) | Parts of water (y) | Hue of dyed fabric |
|---|---|---|---|
| C.I. Vat Orange 29 | 14.5 | 830.5 | Orange |
| C.I. Vat Blue 18 (C.I. 59815) | 10.5 | 834.5 | Blue |
| C.I. Vat Green 3 (C.I. 69500) | 13 | 832.0 | Green |
| C.I. Vat Red 10 | 25 | 820.0 | Red |
| C.I. Vat Brown 1 (C.I. 70800) | 13 | 832.0 | Brown |
| C.I. Vat Orange 11 (C.I. 70805) | 13 | 832.0 | Yellow |
| C.I. Vat Blue 4 (C.I. 69800) | 19.5 | 825.5 | Blue |
| C.I. Vat Black 25 (C.I. 69525) | 14 | 831.0 | Black |
| C.I. Vat Green 1 (C.I. 59825) | 8.5 | 836.5 | Green |

If a stock vat containing 10 parts of monohydroxyacetone is used, it is possible to speed up the vatting (reduction) of the dyes still further.

If desired, the vatting can also be speeded up by treating the stock vat with ultrasound (55° C., frequency: 20 kHz, 50 to 100 watt), for example in the case of the dyes C.I. Vat Red 10 or C.I. vat Green 3.

What is claimed is:

1. A process for dyeing and printing cellulosic fibre materials with vat dyes in the presence of $C_2$–$C_6$-alpha-hydroxyketones or $C_2$–$C_6$-alpha-hydroxyaldehydes as reducing agents, alkali, and in addition organic water-miscible solvents wherein the organic water-miscible solvents are lower molecular weight alcohols, ketones, ethers, acetals, glycols, glycol ethers, thioglycols, nitriles, pyridines, lactams, amides, ureas, sulfones or sulfoxides or low molecular weight alkanolamines.

2. A process according to claim 1 for dyeing cellulosic fibre materials with vat dyes from aqueous alkaline dyeing liquors in the presence of $C_2$–$C_6$-alpha-hydroxyketones or $C_2$–$C_6$-alpha-hydroxyaldehydes as reducing agents, wherein the dyeing liquors additionally contain 0.1 to 10% by weight of the water-miscible organic solvent.

3. A process according to claim 2, wherein the organic solvent is a $C_1$–$C_4$alcohol, acetone, methyl ethyl ketone, cyclohexanone, diisopropyl ether, dioxane, tetrahydrofuran, glycerol formal, glycol formal, ethylene glycol, propylene glycol, ethylene glycol dimethyl ether, ethylene glycol monomethyl, monoethyl or monobutyl ether, diethylene glycol monomethyl or monoethyl ether, thiodiglycol, acetonitrile, pyridine, γ-butyrolactone, pyrrolidone, N-methylpyrrolidone, 1,5-dimethylpyrrolidone, formamide, N,N-dimethylformamide, acetamide, N,N-dimethylacetamide, tris(dimethylamido) phosphate, bis(dimethylamido)-methane phosphate, N,N,N',N'-tetramethylurea, tetramethylene sulfone, β-methyl sulfolane or dimethyl sulfoxide.

4. A process according to claim 3, wherein the organic solvents are ethanol, n-propanol, n-butanol; methanol or isopropanol.

5. A process according to claim 2, wherein the organic solvent is ethanolamine, diethanolamine, triethanolamine. n-propanolamine or isopropanolamine.

6. A process according to claim 2 for dyeing cellulosic fibre materials with vat dyes from aqueous alkaline dyeing liquors at a pH of 11 to 14 and temperatures of 15° to 120° C. and in the presence of mono- or dihydroxyacetone as reducing agent, wherein the dyeing liquors additionally contain 0.1 to 10% by weight of methanol, ethanol or isopropanol.

7. A process according to claim 2 for dyeing cellulosic fibre materials with indigo from aqueous alkaline dyeing liquors in the presence of monohydroxyacetone as reducing agent, wherein the dyeing liquors additionally contain 0.1 to 10% by weight of methanol, ethanol or isopropanol.

8. A process according to claim 1, wherein the reduction of the vat dyes is optionally carried out separately from the actual dyeing/printing process.

9. A process according to claim 8, wherein the separate reduction of the vat dyes and the dyeing/printing process are carried out in a continuous manner.

10. A process according to claim 8, wherein ultrasound is used for reducing the vat dyes, for the dyeing/-printing process or for both steps.

11. An aqueous dyeing liquor or print paste for carrying out a process according to claim 1, which contain a vat dye, an alkali metal hydroxide, $C_2$–$C_6$-alpha-hydroxyketone or $C_2$–$C_6$-alpha-hydroxyaldehyde as reducing agent and additionally 0.1 to 10% by weight, based on the dyeing liquor/print paste, of the water-miscible organic solvent, and optionally customary assistants.

12. An aqueous dyeing liquor or print paste according to claim 11, which contains 0.1 to 7% by weight, based on the substrate to be dyed, of a vat dye, an alkali metal hydroxide in an amount to establish a pH of 11 to 14, 0.01 to 10% by weight, based on the weight of the dyeing liquor/print paste, of $C_2$–$C_6$-alpha-hydroxyketone or $C_2$–$C_6$-alpha-hydroxyaldehyde, and 0.1 to 10% by weight, based on the weight of the dyeing liquor/-print paste, of the water-miscible organic solvent.

13. A dyeing liquor/print paste according to claim 11, which contains mono- or dihydroxyacetone and methanol, ethanol or isopropanol as the organic solvent.

14. A dyeing liquor/print paste according to claim 12, which contains mono- or dihydroxyacetone and methanol, ethanol or isopropanol as the organic solvent.

15. A stable vat dye preparation for preparing an aqueous dyeing liquor or print paste according to claim 11, which contains as well as the vat dye $C_2$–$C_6$-alpha-hydroxyketone or $C_2$–$C_6$-alpha-hydroxyaldehyde as reducing agent in an amount of 1 to 2 vatting equivalents per equivalent of dye the water-miscible organic solvent, and optionally customary assistants, and is transformable by pH adjustment to 11–14, optionally after dilution with water, into the aqueous dyeing liquor/print paste.

* * * * *